US008653988B2

(12) United States Patent
Legare et al.

(10) Patent No.: US 8,653,988 B2
(45) Date of Patent: Feb. 18, 2014

(54) LIGHTING, SIGNAGE AND STORAGE APPARATUS FOR TRAFFIC CONTROL VEHICLE

(76) Inventors: Desiree Legare, Abbotsford (CA); Seigfried Flaming, Abbotsford (CA)

( * ) Notice: Subject to any disclaimer, the term of this patent is extended or adjusted under 35 U.S.C. 154(b) by 564 days.

(21) Appl. No.: 13/020,015

(22) Filed: Feb. 3, 2011

(65) Prior Publication Data

US 2011/0205085 A1 Aug. 25, 2011

Related U.S. Application Data

(60) Provisional application No. 61/301,016, filed on Feb. 3, 2010, provisional application No. 61/411,700, filed on Nov. 9, 2010.

(51) Int. Cl.
*G08G 1/095* (2006.01)
*G09F 15/00* (2006.01)

(52) U.S. Cl.
USPC ..... 340/908; 40/610

(58) Field of Classification Search
USPC ..... 340/907, 480, 425.5, 472, 487, 468, 340/908, 815.53; 40/588, 590, 566, 601, 40/610; 362/486, 233; 116/28 R, 63 R, 63 P
See application file for complete search history.

(56) References Cited

U.S. PATENT DOCUMENTS

| | | | | | |
|---|---|---|---|---|---|
| 1,291,553 | A * | 1/1919 | Kodama | 116/39 |
| 4,152,854 | A * | 5/1979 | Berry et al. | 40/610 |
| 4,259,660 | A * | 3/1981 | Oliver | 340/480 |
| 5,083,826 | A * | 1/1992 | McCrary | 296/21 |
| 5,097,612 | A * | 3/1992 | Williams | 40/591 |
| 5,276,424 | A * | 1/1994 | Hegemann | 340/321 |
| 5,365,687 | A * | 11/1994 | Sclater | 40/610 |
| 5,438,780 | A * | 8/1995 | Winner | 40/514 |
| 5,465,883 | A * | 11/1995 | Woodward | 224/495 |
| 6,412,203 | B1 * | 7/2002 | Libhart et al. | 40/591 |
| 6,598,327 | B1 * | 7/2003 | Strzeletz | 40/591 |
| 2005/0210722 | A1 * | 9/2005 | Graef et al. | 40/452 |
| 2005/0252053 | A1 * | 11/2005 | Pena | 40/591 |
| 2006/0201038 | A1 * | 9/2006 | Haubert | 40/591 |
| 2009/0096236 | A1 * | 4/2009 | Hawley | 296/3 |
| 2009/0255887 | A1 * | 10/2009 | Mrowiec | 211/85.8 |

* cited by examiner

*Primary Examiner* — Benjamin C Lee
*Assistant Examiner* — Sigmund Tang
(74) *Attorney, Agent, or Firm* — Island IP Law; Stephen R. Burri

(57) ABSTRACT

A lighting chassis and equipment rack apparatus for use with a dual purpose lane control vehicle and pilot vehicle. The lighting chassis provides an apparatus for positioning and supporting a flashing arrow board and traffic control signage above the cab of a vehicle, and provides a system of racks for stowage and access for traffic control equipment. The apparatus is adaptable for use on a wide variety of vehicles.

20 Claims, 20 Drawing Sheets

LIGHTING, SIGNAGE AND STORAGE APPARATUS FOR TRAFFIC CONTROL VEHICLE

FIELD OF THE INVENTION

The present invention relates to vehicle attachments. In particular, the present invention relates to lighting and signage chassis and stowage compartment racks for traffic control lane closure and pilot vehicles.

SUMMARY OF THE INVENTION

There is provided a rack system for a traffic control vehicle having a cab and a deck, the rack system having an equipment storage rack attachable to the deck; a lighting chassis attached to the equipment storage rack and extending above the cab; a flashing arrow board pivotally mounted on the lighting chassis; a traffic control sign mounted on the flashing arrow board; and control means for controlling pivoting of the flashing arrow board.

The equipment storage rack may have one or more separate compartments, for example, a sign and stand compartment, and a spring stand compartment. One of the compartments may be situated below at least one of the other compartments.

The equipment storage rack may have at least one rearward door for enclosing one or more compartments, and may have locking means. Each compartment may have an outside surface of checkered steel plate. All compartments of the storage rack apparatus may be accessible from the rear of the vehicle.

At least one of the compartments may measure at least 70 cm by at least 70 cm. At least one of the compartments may measure at least 120 cm by at least 120 cm. At least one of the compartments may have a capacity of at least four spring stands. At least one of the compartments may have a capacity of at least 12 traffic tripods.

The flashing arrow board may be pivotable between a vertical use position and a horizontal non-use position, and the flashing arrow board and traffic control signs may be removable from the lighting chassis.

The lighting chassis may have one or more expanded metal members positioned between the cab and the equipment storage compartments. The equipment storage rack and lighting chassis may be manufactured of aluminum. The control means may be situated within the cab of the vehicle.

The rack system may be used in a variety of vehicles, including a pickup truck or a flatbed truck. The equipment storage rack may be enclosable within the box of the pickup truck.

BRIEF DESCRIPTION OF THE DRAWINGS

A detailed description of the preferred embodiments is provided below by way of example only and with reference to the following drawings, in which.

Figure 1A:
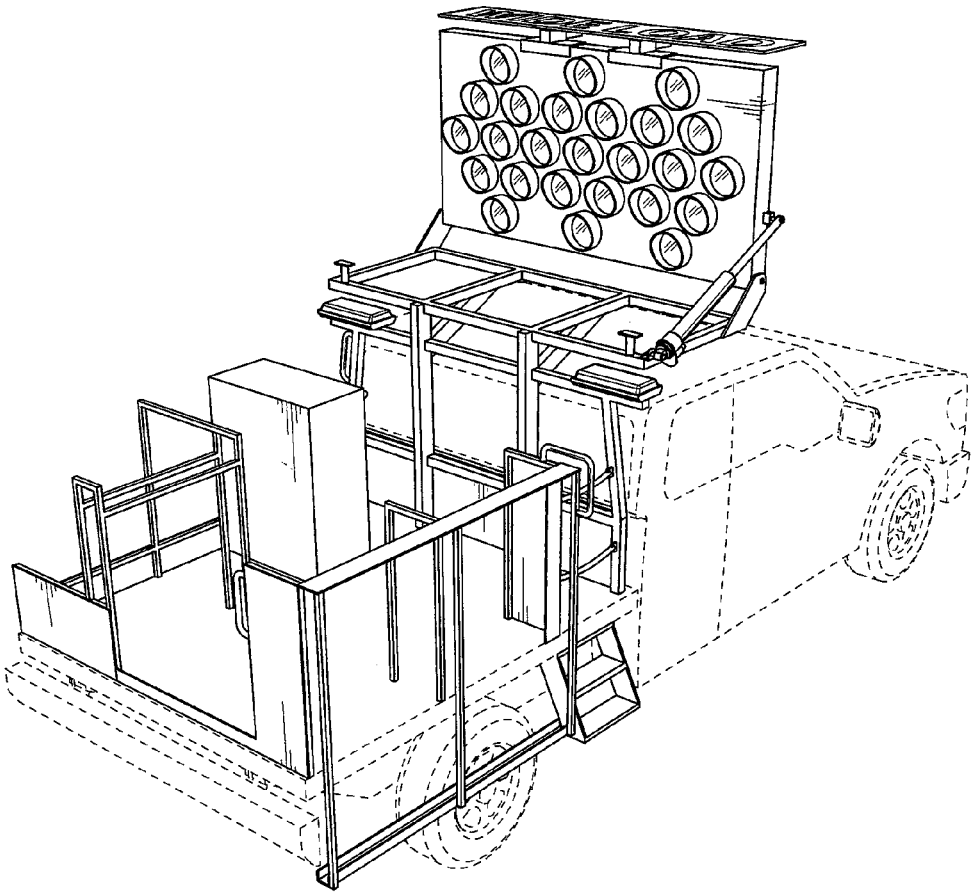
FIGS. 1A and 1B depict a rear perspective view of one embodiment of the present invention for use on a flat bed truck with a flashing arrow board in a raised position.

In the drawings, one embodiment of the invention is illustrated by way of example. It is to be expressly understood that the description and drawings are only for the purpose of illustration and as an aid to understanding, and are not intended as a definition of the limits of the invention.

DESCRIPTION OF THE PRESENT INVENTION

There is provided a lighting chassis and equipment storage rack apparatus for use with a dual-purpose vehicle for lane control vehicle and piloting. As depicted in the various figures, the apparatus of the present invention provides a lighting chassis for positioning and supporting a flashing arrow board and pilot car or other traffic control signage above the cab of a vehicle. The apparatus of the present invention also provides a system of stowage racks for safe, secure stowage and ease of access of traffic control equipment.

The apparatus may be adapted for use on a wide variety of vehicles, preferably trucks, including compact, moderate-sized, intermediate-sized, one-tonne, and 3-tonne trucks, as well as trucks with minor alterations. The apparatus may be adapted for use with all makes and models of such vehicles from light-duty to highway trucks which can bear the weight of the truck-mounted attenuator required for freeway driving of such vehicles.

According to one embodiment which is referred to in this application as the "LEVI" model, as shown in FIGS. 1-5 and 11, the present invention comprises a lighting chassis, a sign and stand holder, a spring stand highway carrier, and a controller for use on a flat bed truck.

As best seen in FIGS. 6A-B, 7A-B, and 12-17, according to another embodiment of the present invention, there is provided a traffic control apparatus for use on a pickup having a box. This embodiment is referred to as the "GAD" embodiment.

The overall construction of the rack system comprises a chassis structure preferably made of aluminum. The lighting chassis component comprises a frame structure connected to a pilot car sign rack and a flashing arrow board ("FAB")

positioned above the cab of the vehicle. The conjunction of these two tools permits dual use of the vehicles, as both lane control vehicles and pilot vehicles.

Figure 1B:
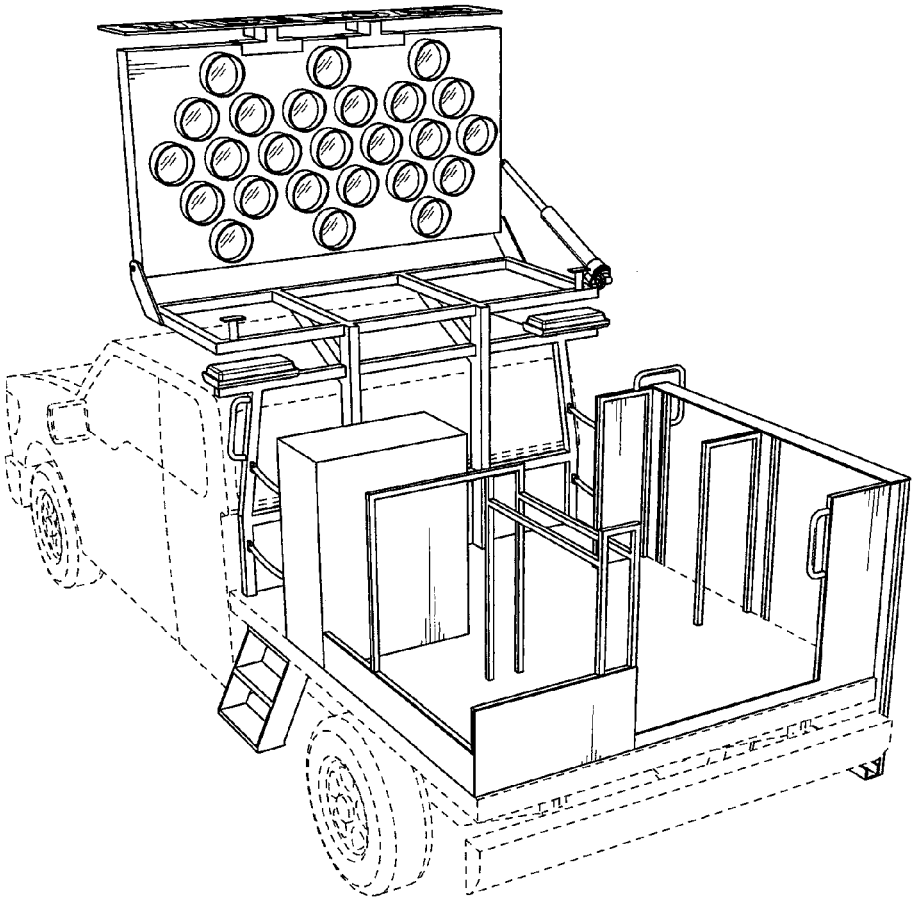
Figure 2A:
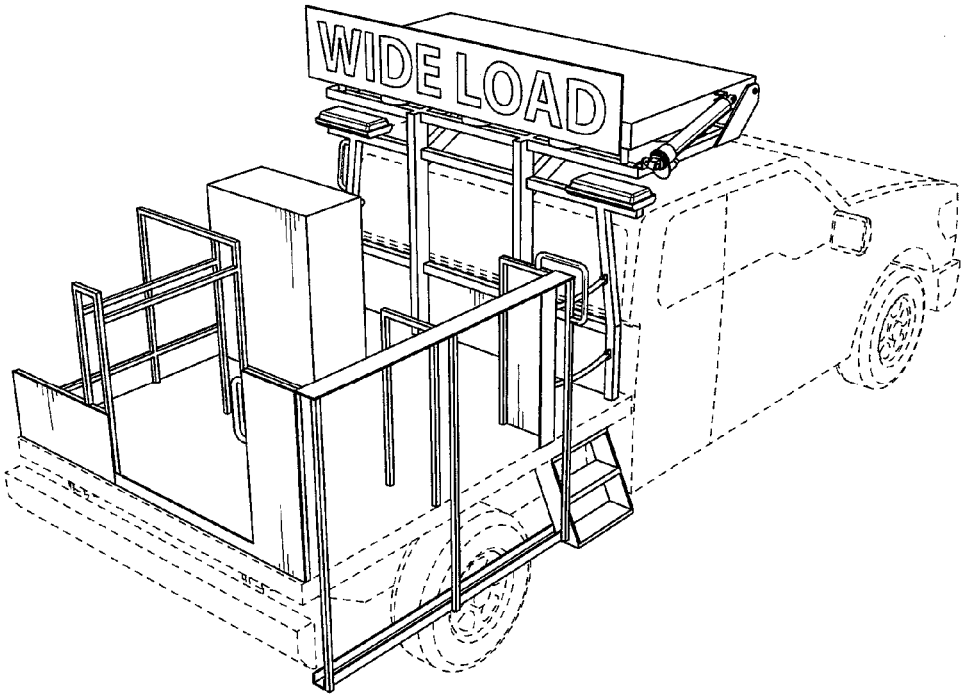
FIGS. 2A and 2B depict this embodiment with a pilot car sign in a displayed position.
Figure 2B:
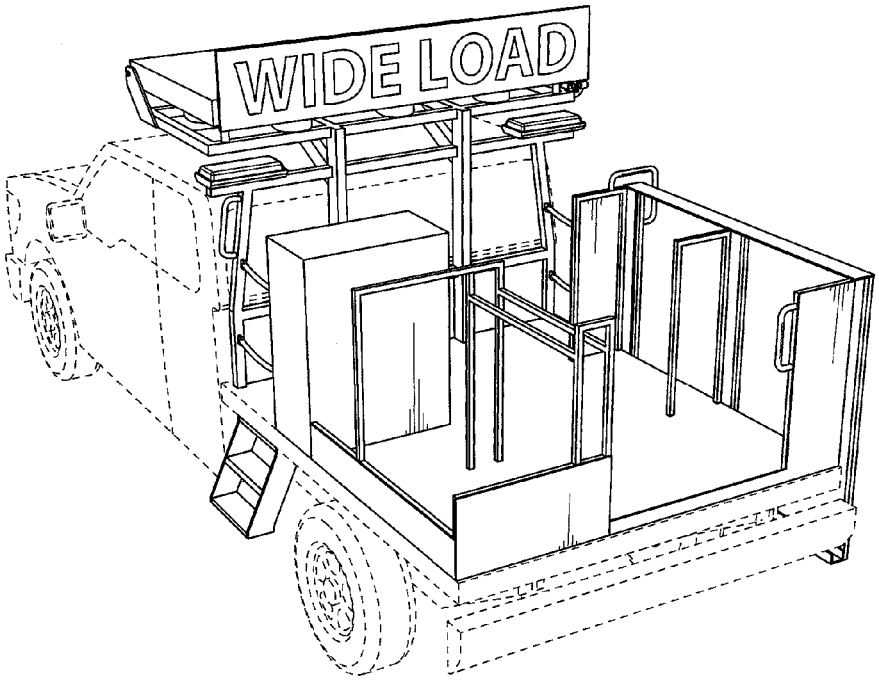
Figure 3:
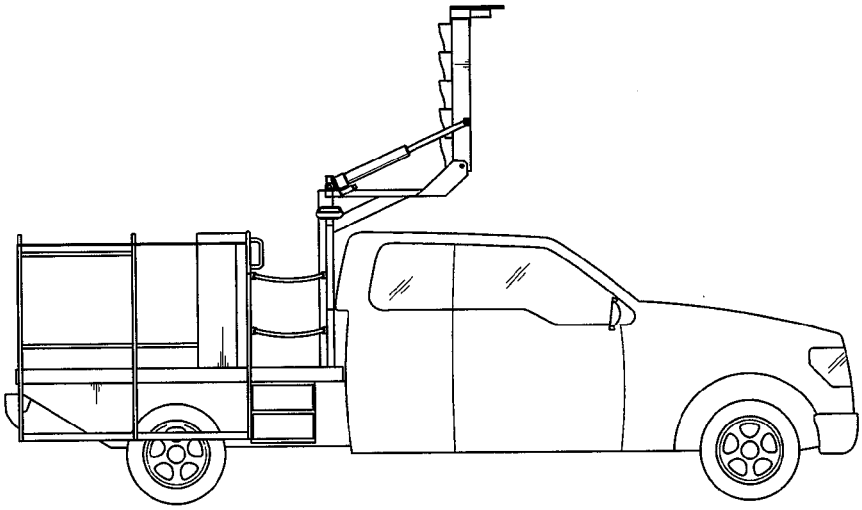
FIG. 3 is a left side view of one embodiment of the apparatus of the present invention.
Figure 10:
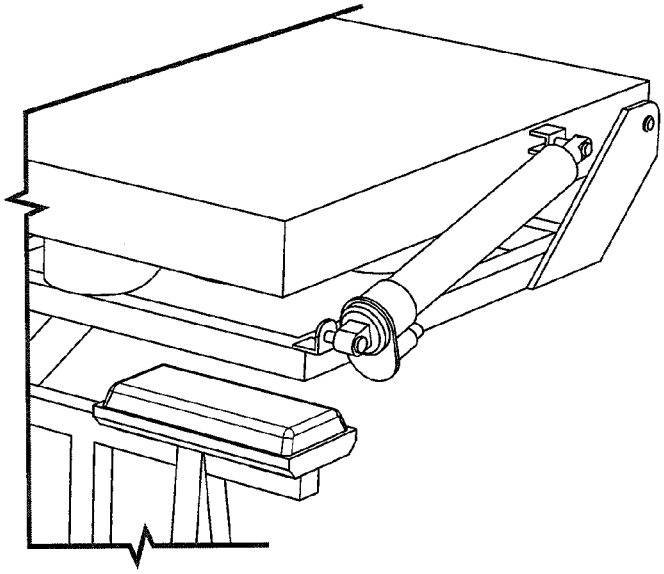
FIG. 10 is a view of the lighting chassis actuator, according to one embodiment of the invention.
Figure 11:
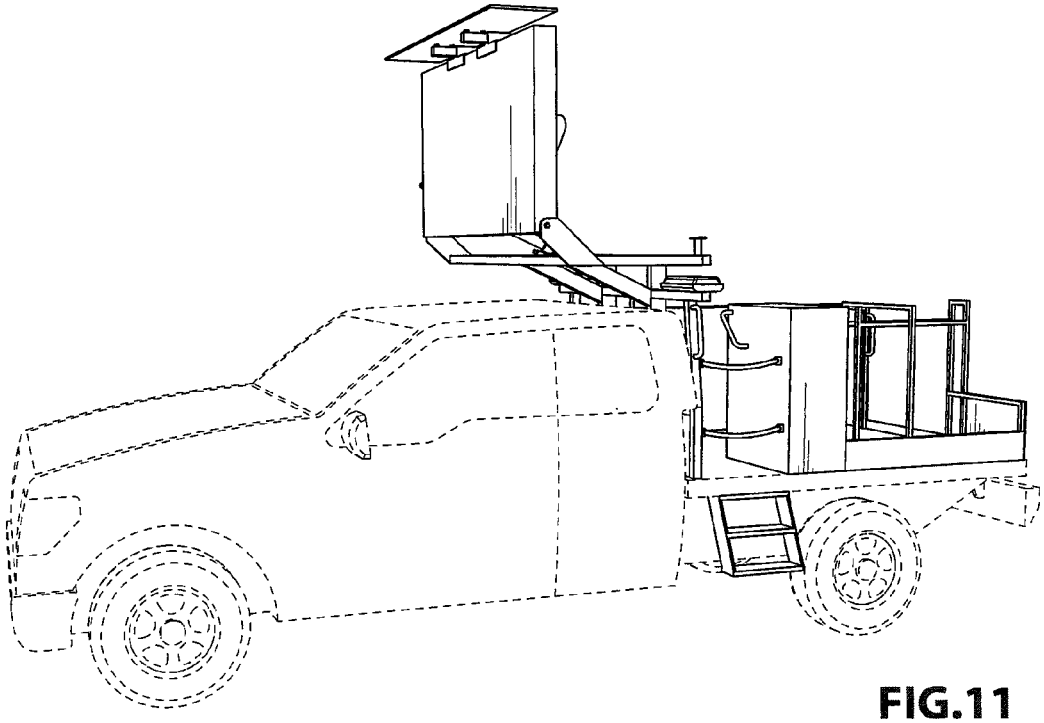
FIG. 11 is a right side perspective view of one embodiment of the apparatus of the present invention.

A flashing arrow board may be pivotally connected to the top of the lighting chassis structure with rivets, brackets or other attachment means. The flashing arrow board is pivotable between a raised vertical in-use position and a lowered horizontal non-use position. When in use, the flashing arrow board is raised perpendicular to the horizontal frame, as shown in FIGS. 1A and 1B. When not in use, the flashing arrow board lies generally above a horizontal portion of the chassis above the cab of the vehicle, as shown in FIGS. 2A and 2B. The flashing arrow board may be pivoted between its raised and lowered positions using a 12-volt electric actuator which raises the flashing arrow board into a working position and returns it to its non-use position, as shown in FIG. 10. Other actuator means are also possible.

One advantage of a pivoting flashing arrow board which can be made to lie flat is prevention of stress on the aluminum frame from the force of wind while the vehicle is in motion, as such stress may cause bending of the frame. In addition, the ability to lower the flashing arrow board allows improves clearance while moving between worksites.

Another advantage with being able to lie the flashing arrow board flat is the ability to mount a pilot car sign rack and to use the same vehicle for piloting wide loads, long loads, oversized loads, and utility vehicles while they examine their next site location (for example, when there are communications poles, cable faults or downed power lines, and power failure). Use of a pilot car sign is a more acceptable way to safely follow such vehicles, rather than the conventional caution symbols provided by a flashing arrow board. Some government regulators, for example, the British Columbia Ministry of Transportation, deem use of a pilot car sign to be correct in such situations, as opposed to use of an FAB.

Figure 8:
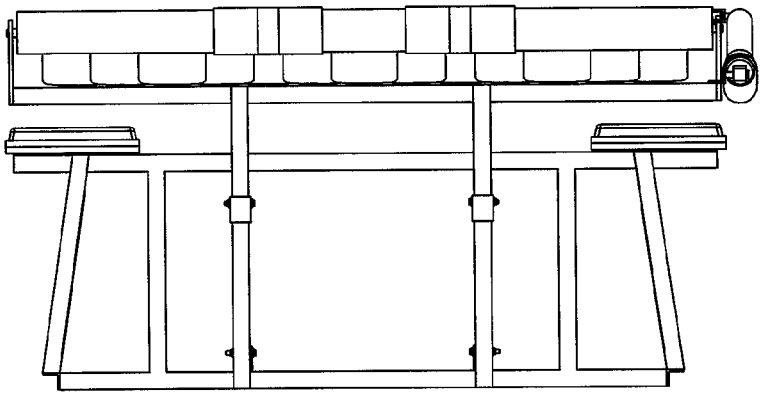
FIG. 8 is a rear view of one embodiment of the lighting chassis of the present invention.
Figure 20:
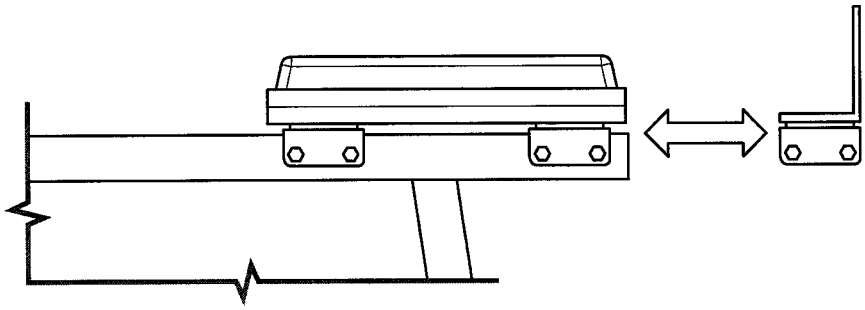
FIG. 20 shows a bracket attachable to the lighting chassis.

This cantilever framed lighting chassis is situated over the cab, and may be permanently fixed to the deck of the truck, although the pilot car sign is removable at any time. As depicted in FIGS. 8A and 8B, a railing below the lighting chassis provides two mounts for LED lights, one on either side of the aluminum rail. The location of this railing is selected to avoid obstruction by equipment stowage compartments. Beacons may be permanently fastened to the brackets on the secondary rail, directly below the FAB/PILOT lighting chassis. As shown in FIG. 20, additional brackets may easily be added to the lighting chassis.

Figure 9:
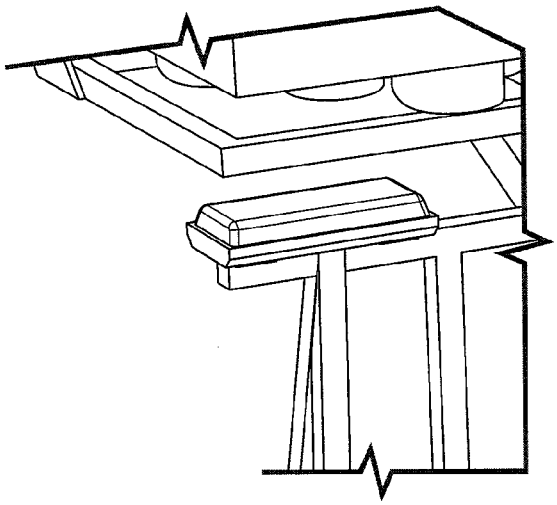
FIG. 9 is a right side perspective view of one embodiment of the apparatus of the present invention.
Figure 19:
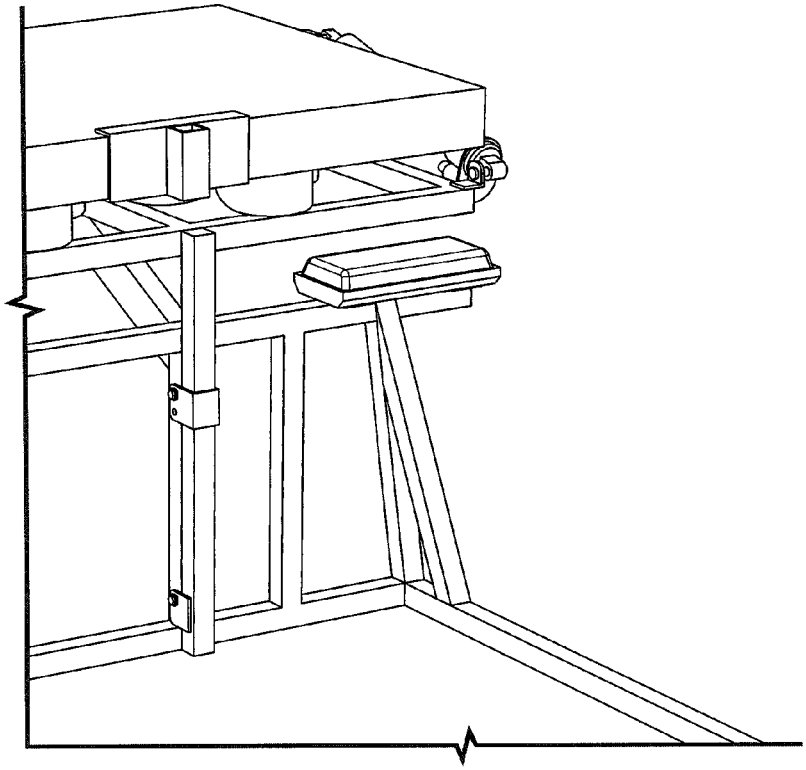
FIG. 19 shows connections between unit frame and lighting chassis frame.

As shown in FIGS. 9 and 19, attached to the FAB/PILOT lighting chassis may be at least one and preferably two expanded metal members which serve to protect the cab from damage caused by loose equipment should any such equipment become projectiles in a traffic incident.

The apparatus of the present invention is considerably less heavy than prior art systems. In the prior art, a conventional heavy system would require two people to carry the rack, and the mount would be permanently affixed to the top of the cab or its mounted rack. With prior art rack systems, often people would drill holes in the top of the cab to keep these sign racks in place. This is not necessary with the system of the present invention.

In operation, the FAB/PILOT lighting chassis apparatus reduces fuel consumption by reducing wind resistance relative to prior art systems. The aerodynamic design is achieved by laying the FAB flat when not in use, while allowing air to flow above and below the FAB. In addition, by lowering the overall height of the vehicle system, collisions with low objects are avoided, thereby preventing potential damage to the FAB.

The present invention enables its users to provide multiple services. Often, when a wide, long or oversized load arrives at its destination, some form of traffic control is desirable or necessary to safely remove its cargo, or to move the load into its final destination. For example, the final destination may be a driveway with difficult access, requiring control of nearby traffic. It is desirable that the pilot car also be able to function as a lane control vehicle with proper signs and equipment to handle the temporary work zone is very desirable in a pilot car.

The ability to follow utility crews around with the proper signage to signify the exact caution information required by motorists brings clarity to drivers following work crews. The drivers would understand the work zone is moving and in progress, rather than the confusion of the caution symbols as they follow these vehicles. This brings clarity and fuel efficiency to the traffic control world.

Figure 4:
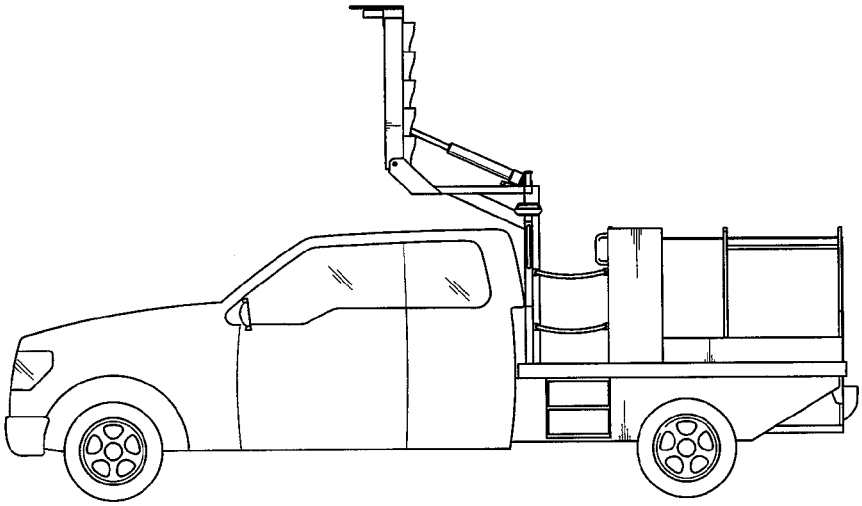
FIG. 4 is a right side view of one embodiment of the apparatus of the present invention.
Figure 5:
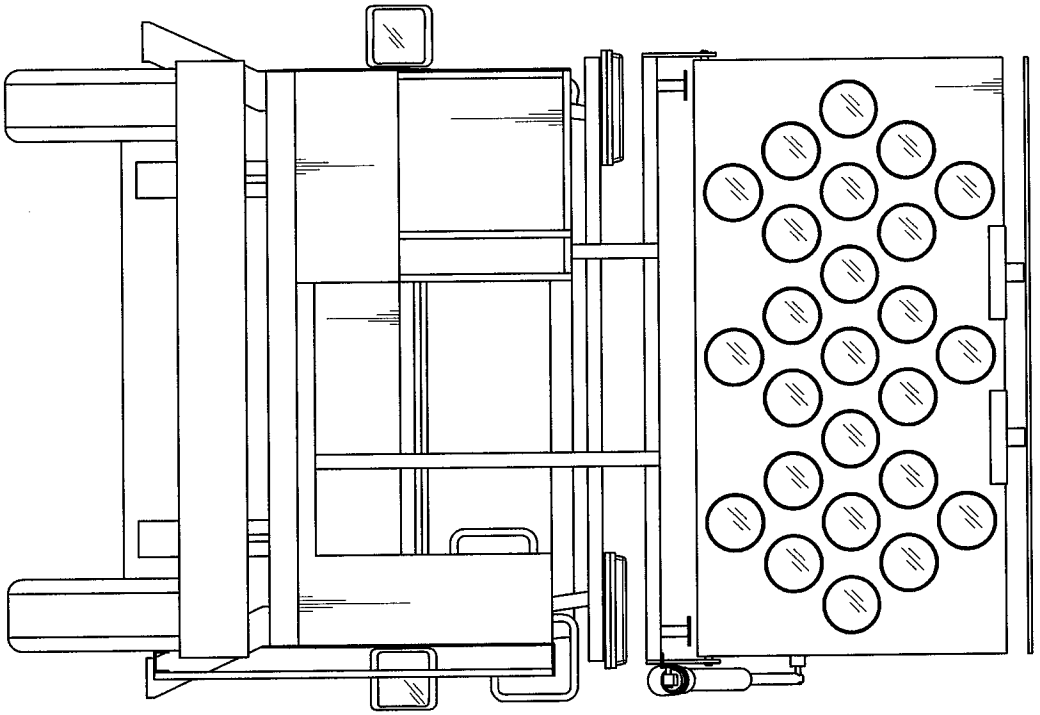
FIG. 5 is a rear view of one embodiment of the apparatus of the present invention.
Figure 12:
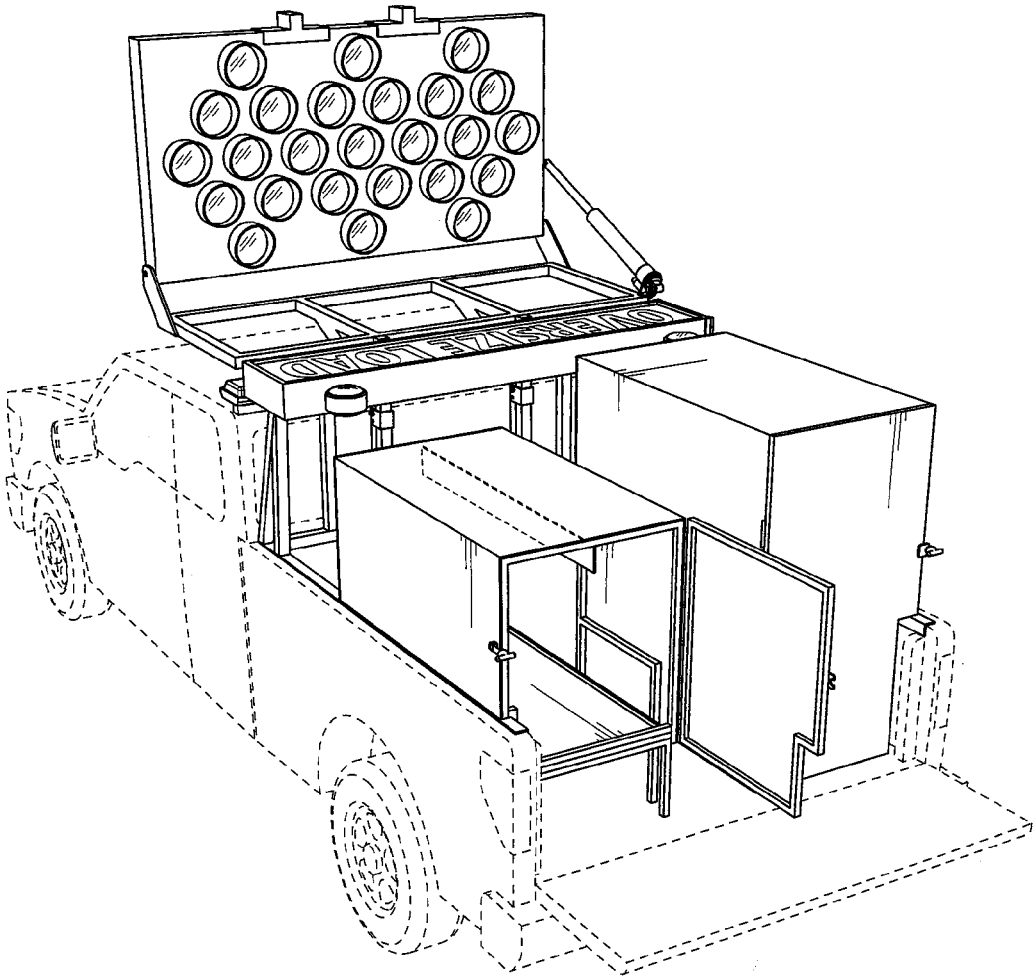
FIG. 12 is a rear perspective view of sign and stand rack for one embodiment of the present invention.

In one embodiment seen in FIGS. 4 and 5, the sign and stand holder component of the present invention dually functions as a toolbox and a secure method of transporting the sign stands and signs. One can also place several spring-loaded stands in this rack. The compartment may be closed in with a rear door which securely fastens the equipment in its place. After the latch is locked these items cannot easily be stolen without forced entry. Preferably, the outside surface is checkered steel plate for design and durability. As shown in FIG. 12, a linear guide may extend along the inside upper surface of the sign and stand holder to assist in organization and ease of access to signs and equipment stored in the compartment.

As well seen in FIGS. 14-17, the GAD embodiment of the present invention is contained within the box of a pickup. The tailgate of the pickup serves to reinforce the security of the stored equipment, making it difficult to remove by vandals or thieves.

To the front of this compartment is a completely enclosed checker-plated aluminum surface. In case of impact these heavy items are deterred from becoming projectiles by the enclosure barrier. This also encloses the items and protects them from any theft. The stands may be stowed one on top of another to save space. A safety pin, comprising a long skinny tubular pin which runs down the vertical on the shelves, may be provided to secure the stands. This catches the items and prevents them from coming loose while being transported.

Adjacent to the spring loaded sign carrier compartments is a recessed compartment that preferably is no thicker than 3 inches and is used for stowing highways signs which measure up to 120 cm by 120 cm and are very thin. The sign carrier compartment may be used to stow the maximum amount required for any work zone. This compartment extends all the way to the box itself and is slightly higher than the spring loaded stand compartment.

Figure 6A:
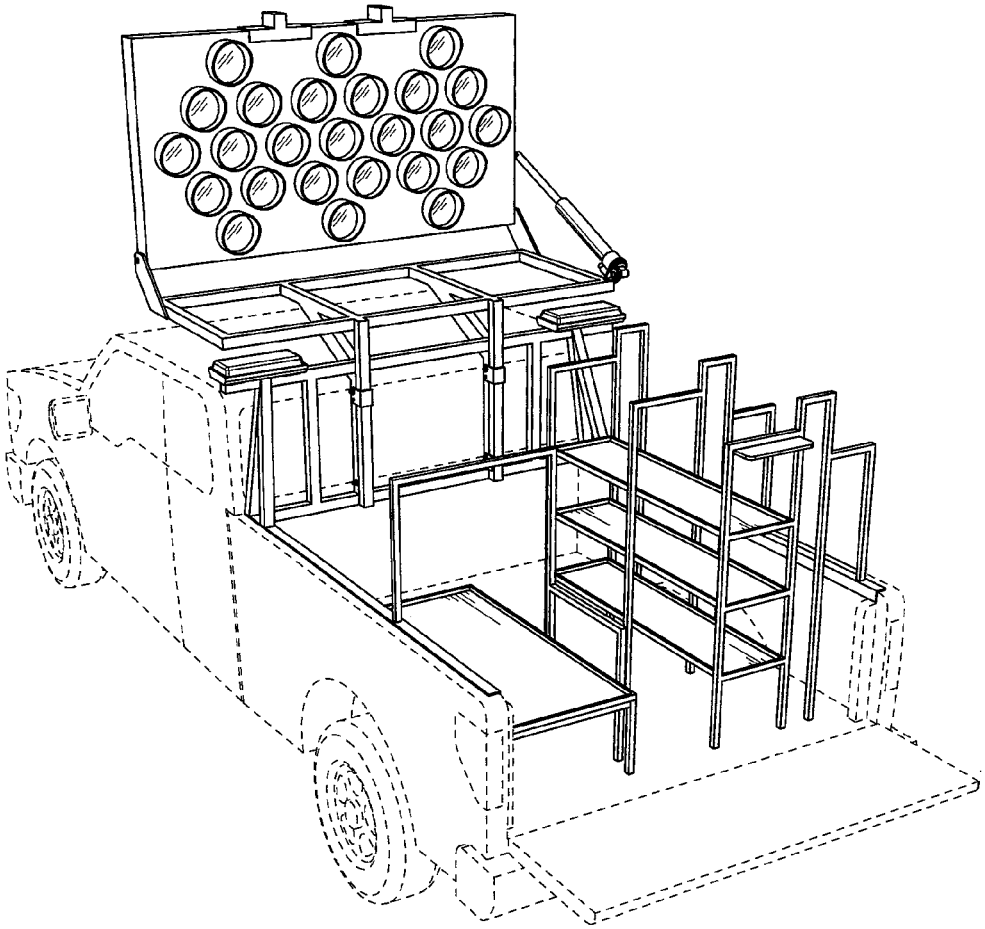
FIGS. 6A and 6B depict a rear perspective view of one embodiment of the present invention for use on a pickup truck having a box with a flashing arrow board in a raised position.
Figure 6B:
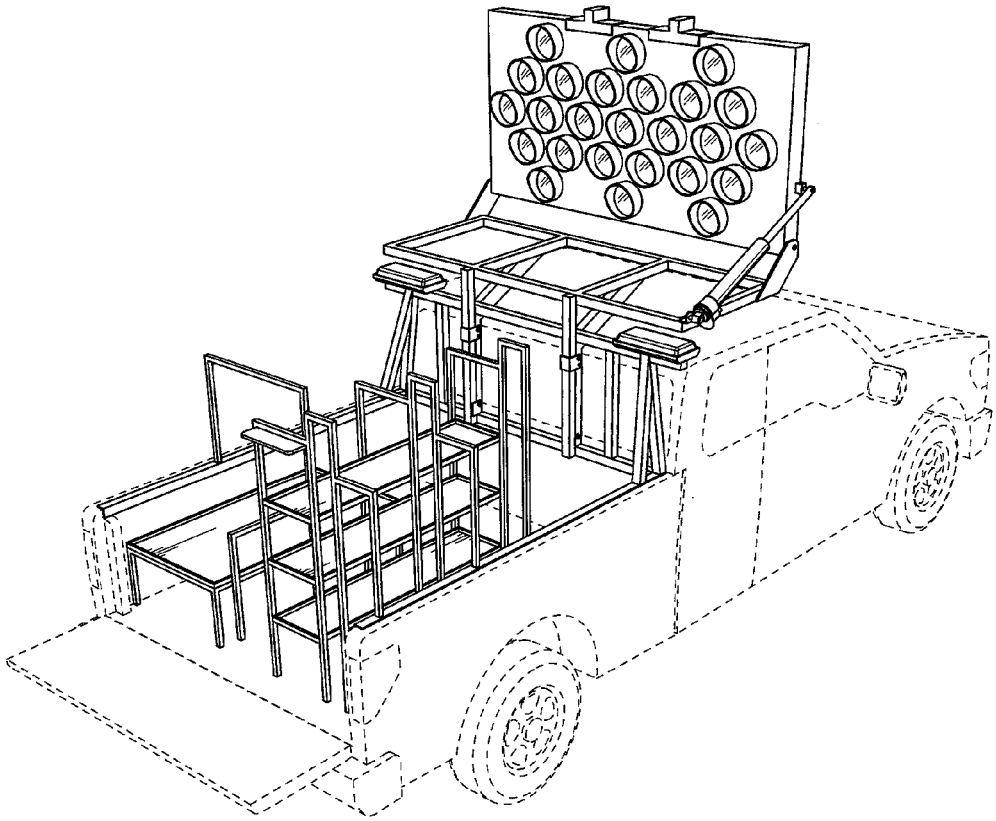
Figure 7A:
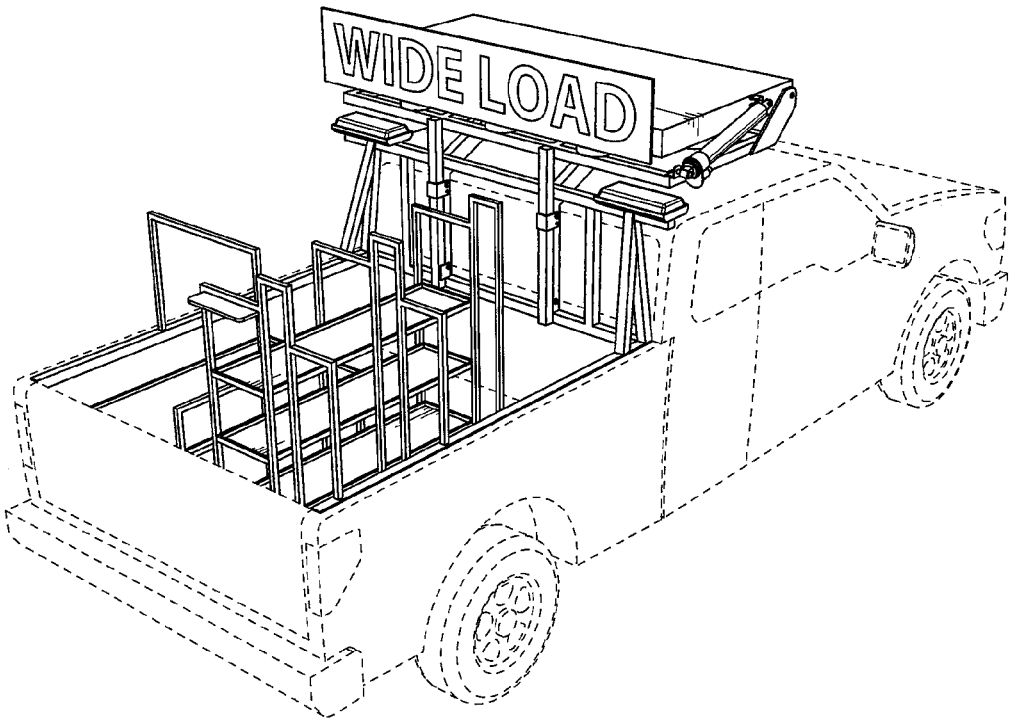
FIGS. 7A and 7B depict this embodiment with a pilot car sign in a displayed position.
Figure 7B:
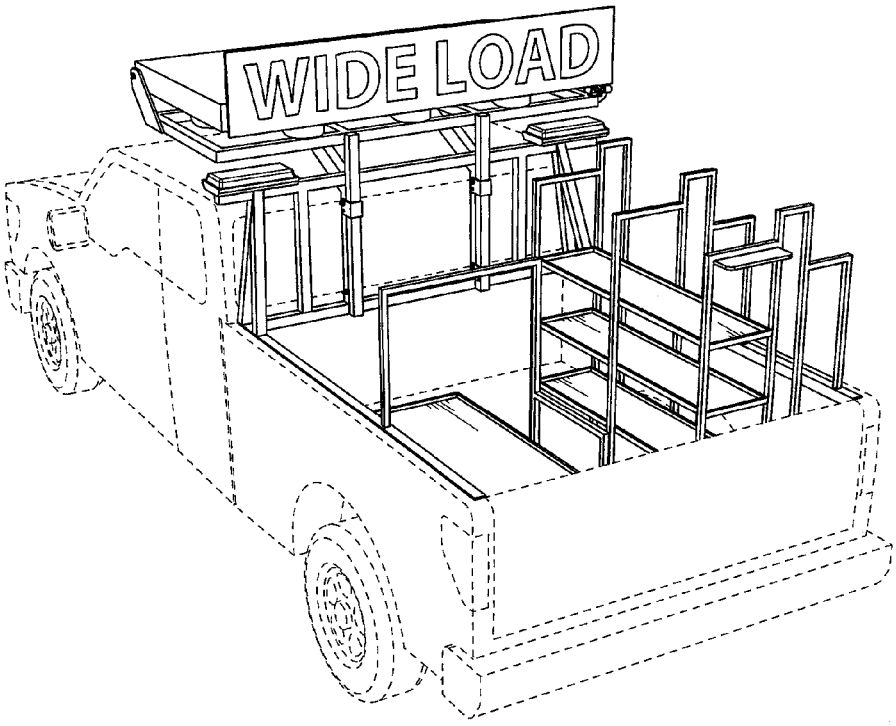
Figure 13:
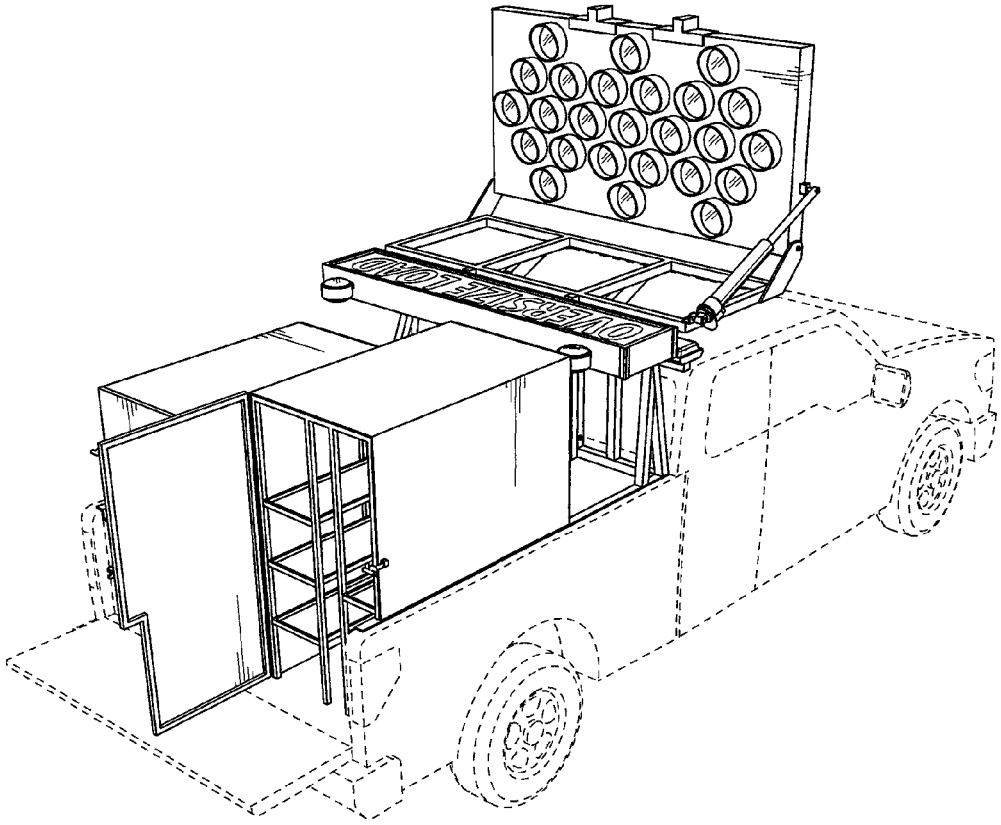
FIG. 13 depicts a tripod shelving unit and stand racks for one embodiment of the present invention.
Figure 14:
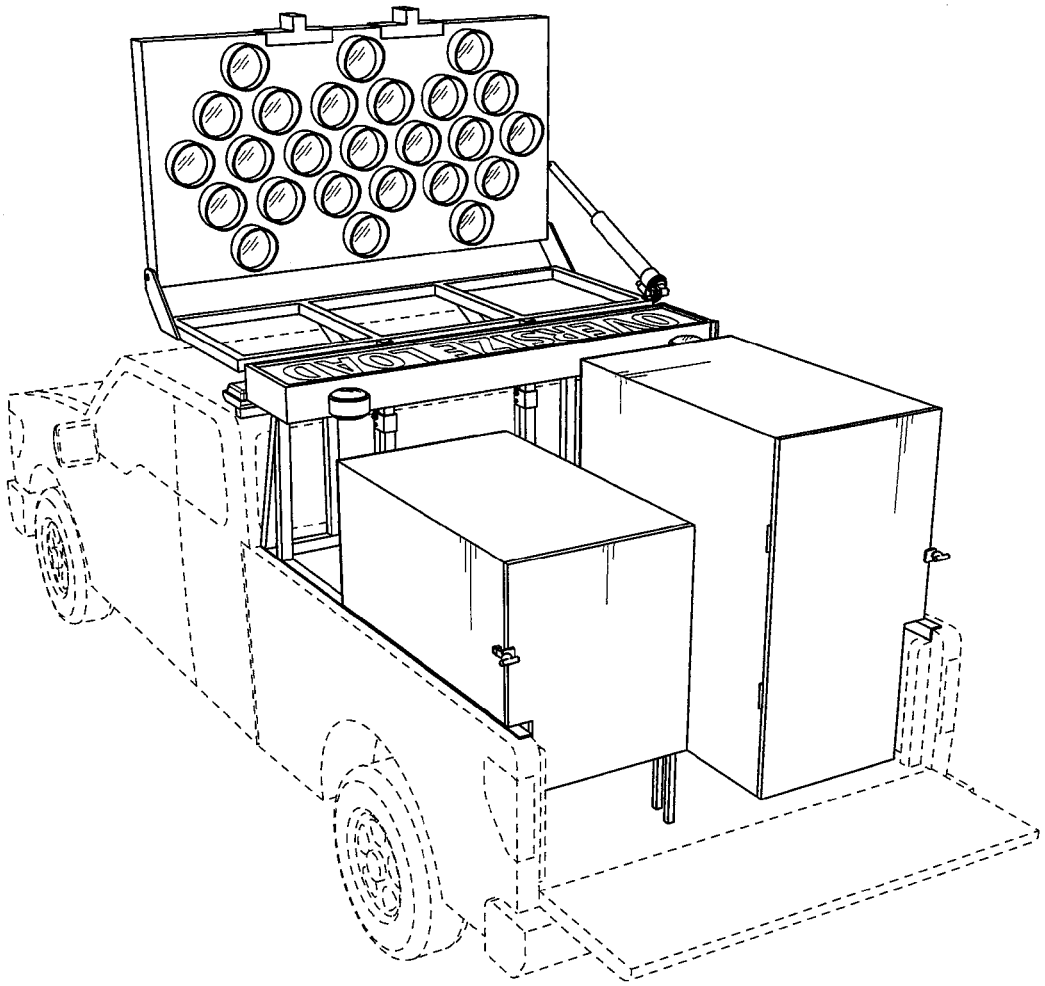
FIG. 14 shows a rear perspective view of the GAD embodiment of the present invention with tailgate open.
Figure 15:
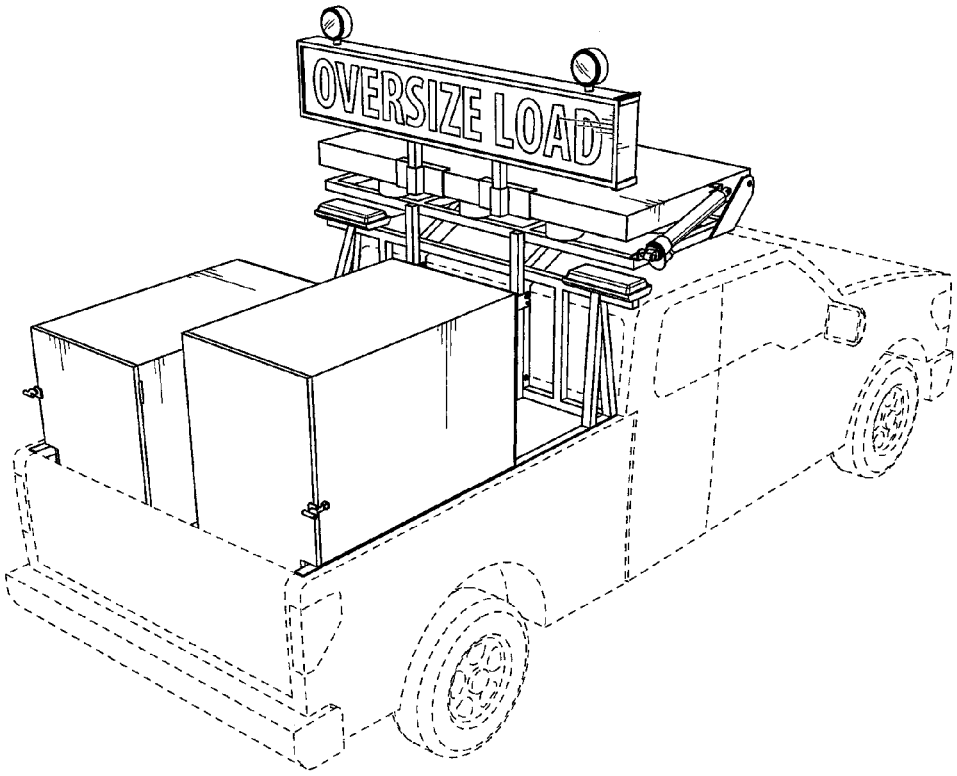
FIGS. 15 and 16 are rear perspective view of a GAD embodiment with pickup tailgate closed.
Figure 16:
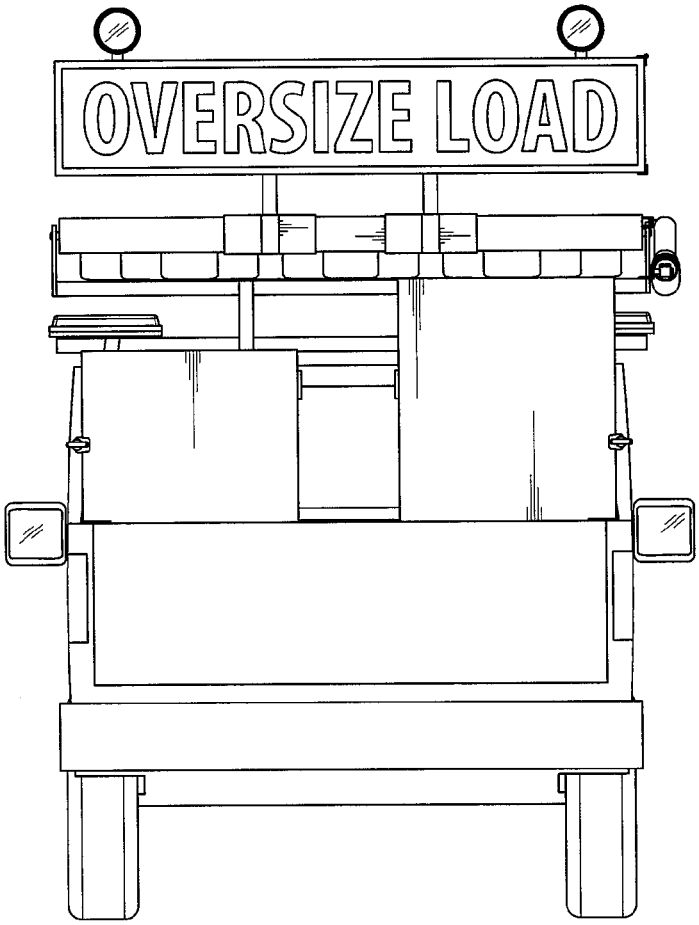
Figure 17:
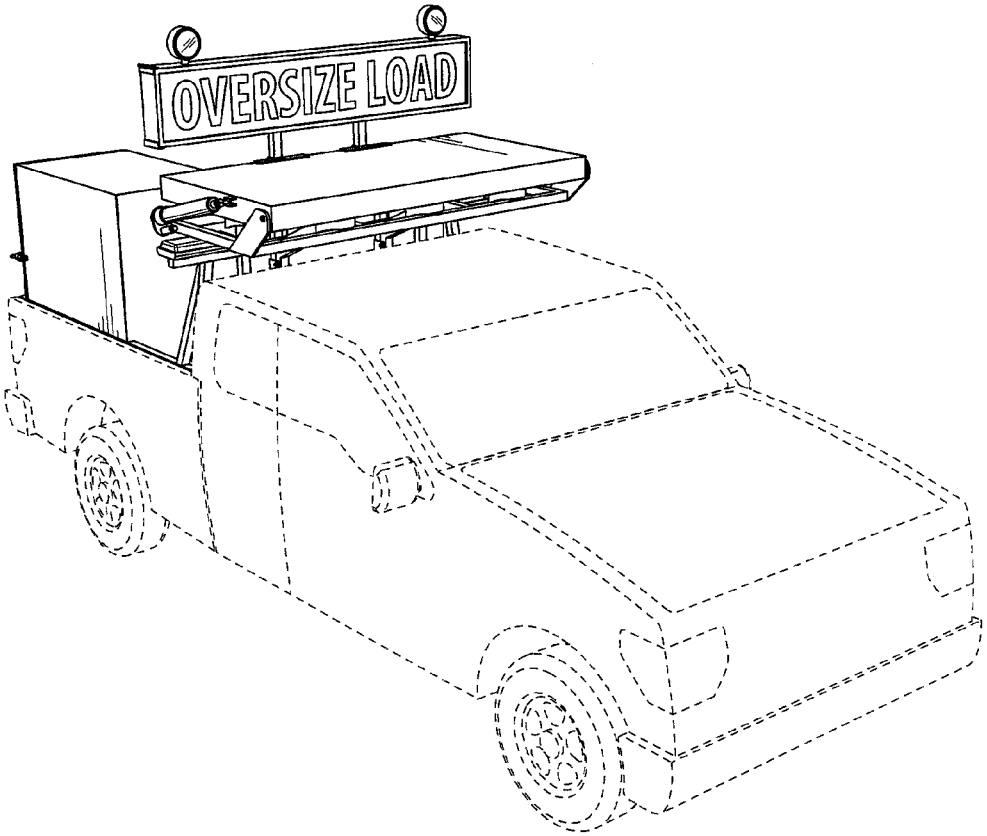
FIG. 17 is a front perspective view of the GAD embodiment of the present invention.

As shown in FIGS. 6A, 7B, and 13, according to the GAD embodiment of the present invention for use on a pickup with a box, the stand rack may be designed to store four spring loaded stands on a shelving unit complete with a welded metal lip to keep the stands from flying out should the safety pin which holds the stands in place not be fastened. The shelves may be enclosed with checkerboard aluminum for security and safety. As best seen in FIG. 13, sign compartments may be adjacent stand shelving and enclosable with a single rear door.

Separate compartments may also be provided underneath the other compartments for more storage capacity for flags and other items. Access to these compartments was placed to the rear for easy accessibility and so that no equipment can be taken without force. The tailgate may be closed with the apparatus of the present system in place. Once locked, the tailgate prevents theft from the compartments.

The tailgate may further comprise a step tailgate. By unlatching the handle and sliding the step out, the user may climb into the back of the truck to remove the delineators.

Most equipment is accessible from the ground. If a user needs to access the box they can do so safely as a result of a non-slip grip painted coated surface on the box.

In the LEVI embodiment, the sign and stand holder may include a tripod stand holder. The first shelf of the tripod stand holder preferably is surface coated with puck board to allow for easy access by the traffic control person for speed, efficiency and handling purposes. It can stow 12 tripods which corresponds to the number required for any major intersection.

Directly underneath the tripod holder shelving is a stowage compartment for several more spring loaded sign stands. Adjacent to this rack is a sign compartment for signs sized up to 70 cm by 70 cm. The tripod holder includes a lip at the rear door to stop theft by enclosing this open compartment.

A welded-in handle is provided near the front of the sign and stand rack for use when mounting the truck via the attached expanded metal step which may also be welded to the frame on the driver side. This permits mounting of the aluminum truck frame with ease and safety.

The rack of the present invention may be fixed to an aluminum flat deck which the frame of a compact pickup in which the flat deck has been extended to add floor space and give the compact pick the capacity to handle more equipment than the standard light duty pickup truck.

The rear back-up lights and taillights ideally are positioned in a recessed space beyond the aluminum deck frame and bumper to protect the lights from being damaged from equipment, wear and tear, etc. The trailer hitch may have an expanded metal surface step which slots into the trailer hitch and is locked into place. This item cannot be easily stolen and is removable.

In the GAD embodiment, there is also a stand holder which is designed to hold 12 tripods. The puck board surfaced shelving for the tripods includes a welded pivoting lip that can be swung open to allow access to the stowed tripods. When the tailgate of the vehicle is closed and locked, the tripods will be securely stored to prevent theft. Heavier spring loaded stands may also be stowed on the truck bed surface in a manner in which they are hidden and cannot be stolen without forced entry. Below the rack in the GAD embodiment there is provided space to stow two spring-loaded stands which are long and heavy, designed to hold signs in high winds.

The design of the sign and stand rack component of the present invention permits easy access to the equipment and enables set up of work zones in fractions of the time required using prior art systems. The ability to carry all required equipment in the lane closure truck permits truck crew to be accountable for all equipment on the lane closure truck to which they have been assigned. Employees can be trained and expected to be diligent in placing this expensive equipment back on to the trucks, keeping it in very good shape, not to mention recognizing missing equipment immediately and giving the employee the opportunity to find missing equipment in their work zone. The rack is designed to be very accessible at waist heights, reducing risk of work injury. This brings a sense of professionalism to the job of lane closure technician. With the right tools they become fast and efficient at setting up closures.

In prior art systems, equipment was thrown in the back of a pickup truck and there was no industry standard. Employees would spend a great deal of time setting up the work zones because they did not have the right equipment or they could not retrieve it efficiently from the rubble in a timely fashion. Employees could sustain injuries, and while traffic was coming at them at high speeds, they had to pull this tangled equipment from the sides of the truck where the line of traffic was. This was extremely dangerous and needed to be addressed.

According to the apparatus of the present invention, all of the equipment is accessible from the back of the vehicle for speed and safety. While workers still need to keep a careful eye on traffic, they have an opportunity to flee should a motorist go wayward and head for the stagnant lane closure vehicle. The present invention permits an emergency escape, rather than being pinched on the driver side using a prior art apparatus.

The spring stand and highway carrier component of the present invention comprises a rack which has the capacity to hold a three shelved rack with surface coated puck board complete with lip.

Adjacent to that shelving unit and welded attached hangs the compartment for highway signs having dimensions of 120 cm by 120 cm. This rests on the base compartment also surface coated with puck board for easy access and removability. The compartment rest at a lower level for the employees to grab with ease as it is vertical and is no more than 3 cm in width. It takes minimal space yet stows away one of the most difficult pieces of equipment to handle. These items are often larger than the employees who handle them. The hanging compartment extends all the way down the frame and is joined by another expanded metal aluminum step with a forward facing surface which is curved slightly so it will not hook on items as it drives forward. This also improves safety feature when operating this equipment for the traffic control person.

This overhanging compartment is also detachable. With a simple wrench the whole side piece may be removed, for example should the tires need maintenance at any time.

Figure 18:
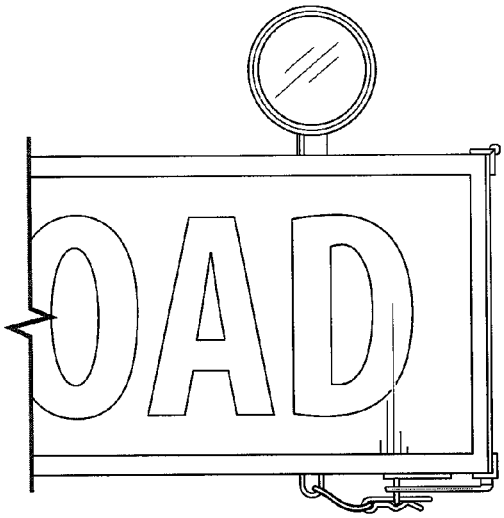
FIG. 18 is a perspective view of a pilot car sign holder, showing latch and cotter pin for sealing sign chamber.

The racks are entirely surfaced with checkered plating, and doors are hinged. The doors may be latched closed and locked so no expensive equipment can be stolen without force. As shown in FIG. 18, the pilot sign compartment may include a latch and cotter pin for ease of change of sign. A lock may also be used to secure the sign.

Forward of the rack above the step is another well rounded handle on either side for mounting onto the flat deck. The remainder of the decks surface is designed to permit stowage of 25-30 tubular markers known as delineators. The flat deck is coated/painted with non-slip material which prevents slipping while working on the deck to remove the equipment.

The equipment on the compact vehicle can all be accessed without mounting the vehicle, all is within reach. In contrast with prior art systems, the present invention does not require the user to mount the vehicle.

The apparatus of the present invention further comprises a control system including a controller box located on the inside of the cab. All lighting may be controlled with the flip of a switch in the controller box in the cab. The pilot car sign, flashing arrow board and beacons may all be installed on the controller and controlled from inside the cab. For example, to raise the actuator which moves the flashing arrow board into position, the user hits the switch which has been built into the dash, directly underneath the steering wheel.

The flat deck model which can be formed to any size of truck frame can outlive the vehicle. When the vehicle motor expires one may simply remove the apparatus and add it to a brand new vehicle. The service company will only be missing that work truck a couple days rather than the standard time it takes to weld a brand new system together, improving the cost effectiveness for the longevity of your business.

By permitting compact, fuel efficient smaller models of trucks to function as pilot and lane closure vehicles, profitability is improved through cost savings on insurance, maintenance, fuel, and materials.

Preferably, the racks of the present system are constructed of aluminum which is lighter weight and requires less fuel to transport than prior art steel systems. With this light weight frame, a heavier payload may be carried without exceeding the vehicle's allocated weight load or compromising safe handling of the vehicle.

The cost is cheaper to fuel this model, the maintenance and insurance is cheaper, it is easier for the employee to access, the speed and efficiency of setting up work zones in a fraction on the time of conventional method racking systems.

The Safety of the workers has been greatly improved.

The equipment does not have to be replaced as often because it is not damaged in the transporting from day to day. It also is not easily stolen and this saves the company a great deal of money as one piece of this equipment stored on the trucks usually exceed hundreds of dollars.

Compared to conventional methods we have carefully stowed away all equipment and by organizing it in such a manner where able to carry more equipment than conventional methods, meaning we are ready for any job any time.

One of the difficulties of the traffic control industry is never knowing with certainty what type of work zone will be faced each day. Sometimes a vehicle may be dispatched to a first site then have to change locations. It is very difficult to access when the proper highway signage will be required. Prior art systems would require use of a highway truck, a small truck and perhaps a pilot truck. The apparatus of the present invention permits one vehicle to take on multiple roles.

As many possible embodiments may be made of the invention without departing from the scope of the claims, it is to be understood that all matter herein set forth or shown in the accompanying drawings is illustrative and not limiting. It will be appreciated by those skilled in the art that other variations of the preferred embodiment may also be practised without departing from the scope of the invention.

The invention claimed is:

1. A rack system for a traffic control vehicle having a cab and a deck, the rack system comprising:

an equipment storage rack attachable to the deck;

a lighting chassis attached to the equipment storage rack and extending above the cab;

a flashing arrow board pivotally mounted on the lighting chassis;

a traffic control sign mounted on the flashing arrow board; and control means for controlling pivoting of the flashing arrow board.

2. The rack system of claim 1, wherein the equipment storage rack comprises one or more separate compartments.

3. The rack system of claim 2, wherein the equipment storage rack further comprises a sign and stand compartment, and a spring stand compartment.

4. The rack system of claim 2, wherein the equipment storage rack further comprises at least one compartment situated below one or more other compartments.

5. The rack system of claim 2, wherein the equipment storage rack further comprises at least one rearward door for enclosing one or more compartments.

6. The rack system of claim 2, wherein the equipment storage rack further comprises locking means.

7. The rack system of claim 2, wherein each compartment has an outside surface of checkered steel plate.

8. The rack system of claim 2, wherein at least one of the compartments has a height of at least 70 cm and a depth of at least 70 cm.

9. The rack system of claim 2, wherein at least one of the compartments has a height of at least 120 cm and a depth of at least 120 cm.

10. The rack system of claim 2, wherein at least one of the compartments has a capacity of at least four spring stands.

11. The rack system of claim 2, wherein at least one of the compartments has a capacity of at least 12 traffic tripods.

12. The rack system of claim 2, wherein all compartments of the storage rack apparatus are accessible from the rear of the vehicle.

13. The rack system of claim 1, wherein the flashing arrow board is pivotable between a vertical use position and a horizontal non-use position.

14. The rack system of claim 1, wherein the flashing arrow board and traffic control signs are removable from the lighting chassis.

15. The rack system of claim 1, wherein the lighting chassis further comprises one or more expanded metal members positioned between the cab and the equipment storage compartments.

16. The rack system of claim 1, wherein the equipment storage rack and lighting chassis are manufactured of aluminum.

17. The rack system of claim 1, wherein the control means are situated within the cab of the vehicle.

18. The rack system of claim 1 for use in a pickup truck.

19. The rack system of claim 18, wherein the equipment storage rack is enclosable within the box of the pickup truck.

20. The rack system of claim 1 for use in a flatbed truck.

* * * * *